US006189994B1

(12) United States Patent
Asai

(10) Patent No.: US 6,189,994 B1
(45) **Date of Patent: *Feb. 20, 2001**

(54) SYSTEM TO DETERMINE INTEGRATED NUCLEATION PROBABILITY IN INK JET RECORDING APPARATUS USING THERMAL ENERGY

(75) Inventor: Akira Asai, Atsugi (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/896,543

(22) Filed: Jul. 18, 1997

Related U.S. Application Data

(63) Continuation of application No. 08/528,605, filed on Sep. 15, 1995, now abandoned, which is a continuation of application No. 08/274,376, filed on Jul. 13, 1994, now abandoned, which is a continuation of application No. 07/908,614, filed on Jun. 29, 1992, now abandoned, which is a continuation of application No. 07/724,455, filed on Jul. 3, 1991, which is a continuation of application No. 07/509,759, filed on Apr. 17, 1990, now abandoned.

(30) Foreign Application Priority Data

Apr. 17, 1989 (JP) ..... 1-095397

(51) Int. Cl.[7] ..... B41J 29/393
(52) U.S. Cl. ..... 347/19; 702/181
(58) Field of Search ..... 347/19, 5; 364/550; 702/181

(56) References Cited

U.S. PATENT DOCUMENTS 4,219,877 * 8/1980 Vladimirov ..... 364/554
4,241,406 * 12/1980 Kennedy .
4,321,688 * 3/1982 Sado ..... 364/554 X
4,723,129 * 2/1988 Endo ..... 347/56
4,734,869 * 3/1988 Mickowski ..... 364/550
4,872,028 * 10/1989 Lloyd ..... 347/14

FOREIGN PATENT DOCUMENTS

11170 * 1/1983 (JP) .

OTHER PUBLICATIONS

Allen et al; Thermodynanics and Hydrodynamics of Thermal Ink Jets; Hewlett–Packard Journal, vol. 36, May 1985, No. 5, Table of Contents and pp. 21–27.*

Hsu, "On the Size Range of Active Nucleation Cavities on a Heating Surface", Journal of Heat Transfer, Aug. 1962, pp. 207–216.

Ward et al., "On the Thermodynamics of Nucleation in Weak Gas–Liquid Solutions", Journal of Basic Engineering, Dec. 1970, pp. 695–704.

Bender et al., "Advanced Mathematical Methods for Scientists and Engineers", McGraw–Hill 1978, Table of Contents and pp. 484–543.

* cited by examiner

*Primary Examiner*—Susan S. Y. Lee
(74) *Attorney, Agent, or Firm*—Fitzpatrick, Cella, Harper & Scinto

(57) ABSTRACT

A method for determining an integrated nucleation probability in a jet recording method using thermal energy, wherein a nucleation rate dependent on a temperature of ink is integrated with time from start of heating of the ink in a predetermined region on a heater for heating the ink.

15 Claims, 5 Drawing Sheets

SYSTEM TO DETERMINE INTEGRATED NUCLEATION PROBABILITY IN INK JET RECORDING APPARATUS USING THERMAL ENERGY

This application is a continuation of application Ser. No. 8/528,605, filed Sep. 15, 1995, which is a continuation of application Ser. No. 08/274,376, filed Jul. 13, 1994, which was a continuation of application Ser. No. 07/908,614, filed Jun. 29, 1992, which was a continuation of application Ser. No. 07/724,455, filed Jul. 3, 1991, which was a continuation of application Ser. No. 07/509,759, filed Apr. 17, 1990, all now abandoned.

FIELD OF THE INVENTION AND RELATED ART

The present invention relates to an analyzing method and system for bubble generation phenomenon in an ink jet recording apparatus using thermal energy, more particularly, to such a method and a system in an ink jet recording method and apparatus wherein liquid is heated to form a bubble, and the rapid volume change resulting from the bubble formation is used to eject the liquid to effect the recording.

The ink jet recording method is particularly noted these days since it is convenient to use a reduced-size recording apparatus, since it is suitable for high resolution recording and since it is suitable for high speed recording.

In such an ink jet recording apparatus, the thermal energy is applied to the liquid to form a bubble therein, and the formation of the bubble causes rapid volumetric change which makes the liquid to eject onto a recording material (recording sheet) to effect the recording.

It is very important in making an efficient design and accomplishing stabilized ink ejection in the apparatus to know the bubble formation phenomenon.

The bubble formation (nucleation) conditions in the ink jet recording method using the thermal energy can be dealt with as a problem of the initial nucleation in the boiling mechanism in liquid. It has been analyzed, heretofore, by the following two methods:

(1) method on the basis of the cavity theory;

(2) method on the basis of the spontaneous nucleation theory;

The first method (1) is based on the assumption that fine bubbles are trapped on the heating surface, and the investigation is made as to the conditions for the growth of bubbles. Typical examples of this method are disclosed in Y. Y. Hsu: Trans. ASME, J. Heat Transfer 84 (1962) pp. 207–216, for a general boiling phenomenon, and R. R. Allen, J. D. Meyer and W. R. Knight: Hewlett-Packard J. 36(1985) No. 5, pp. 21–27 for the bubble jet printer.

The second method (2) is to investigate the conditions for spontaneous formation of vapor bubble in the liquid by the ink molecular movement by heat. Typical examples of this method are disclosed in V. P. Skripov: Metastable Liquids, John Wiley & Sons, New York (1974), for a general boiling phenomenon, and Japanese Laid-open Patent Application Publication No. 206474/1984 for a jet printer.

However, the bubble formation or the nucleation of the ink in the ink jet printer using the thermal energy involves stochastic aspects. The conventional analysis may not be enough to describe the stochastic aspects.

More particularly, the conventional analysis is based on the assumption that the bubble formation starts when the temperature distribution satisfies predetermined conditions. Further particularly, in the method (1), the bubble formation start is deemed as the ink temperature distribution contacting a discrimination curve corresponding to the unstable equilibrium of the bubble: in the method (2), the bubble formation start is deemed as the temperature of the ink in contact with the heating surface reaching the superheat critical temperature.

The inventor's investigations have revealed that the bubble generation start in an ink jet process using the thermal energy is not of such a one point value nature, but it is of the stochastic nature. Even if the same temperature distribution is given, the bubble generation sometimes occurs, and sometimes not. The bubble generation mechanism may not be understood without introduction of the stochastic aspects. In the conventional designing of the ink jet printer using the thermal energy and the evaluation thereof, the trial and error method has to be used due to the uncertainty of the bubble generation phenomenon, and in order to avoid incomplete bubble generation, the design has to include much more than enough margins.

SUMMARY OF THE INVENTION

It is a principal object of the present invention to provide an analyzing method and a system for bubble generation phenomenon in an ink jet recording apparatus using thermal energy, by which the stochastic characteristics can be quantitatively provided.

It is another object of the present invention to provide an analyzing method and system for allowing easier designing of an ink jet recording head, so that a good ink jet recording head can be quickly designed.

It is a further object of the present invention to provide an analyzing method and system by which an ink jet recording head having necessary and sufficient performance can be easily designed when design conditions are given.

According to an aspect of the present invention, there is provided a method for determining an integrated nucleation probability in a jet recording method using thermal energy, wherein a nucleation rate dependent on a temperature of ink is integrated with time from the start of heating of the ink in a predetermined region on a heater for heating the ink.

Accoording to another aspect of the present invention, there is provided a jet recording method using thermal energy to generate a bubble to eject ink to effect recording, wherein an integrated nucleation probability of the bubble generation is determined by integrating a nucleation rate dependent on a temperature of the ink with time from a start of heating of the ink in a predetermined region on the heater, and the method is designed using the thus determined integrated nucleation probability.

According to a further aspect of the present invention, there is provided, an ink jet recording apparatus, comprising: means for retaining ink; an outlet through which the ink is discharged; a heater for heating the ink through the outlet; wherein said apparatus is designed using an integrated nucleation probability determined by integrating a nucleation rate dependent on a temperature of the ink with time from start of heating of the ink in a predetermined region on the heater.

According to a yet further aspect of the present invention, there is provided a system for analyzing a bubble generation phenomenon in an ink jet recording method using thermal energy, comprising: a data input port; memory means for storing a homogeneous nucleation rate; memory means for storing a heterogeneous nucleation rate; memory means for storing an integrated nucleation probability; a program for calculating the integrated nucleation probability in accordance with data from said input port; a central processing unit for controlling said memory means and execution of said program; and a data output port for results of calculation.

DESCRIPTION OF THE PREFERRED EMBODIMENTS

The preferred embodiment of the present invention will be described in detail in conjunction with the accompanying drawings.

Figure 1:
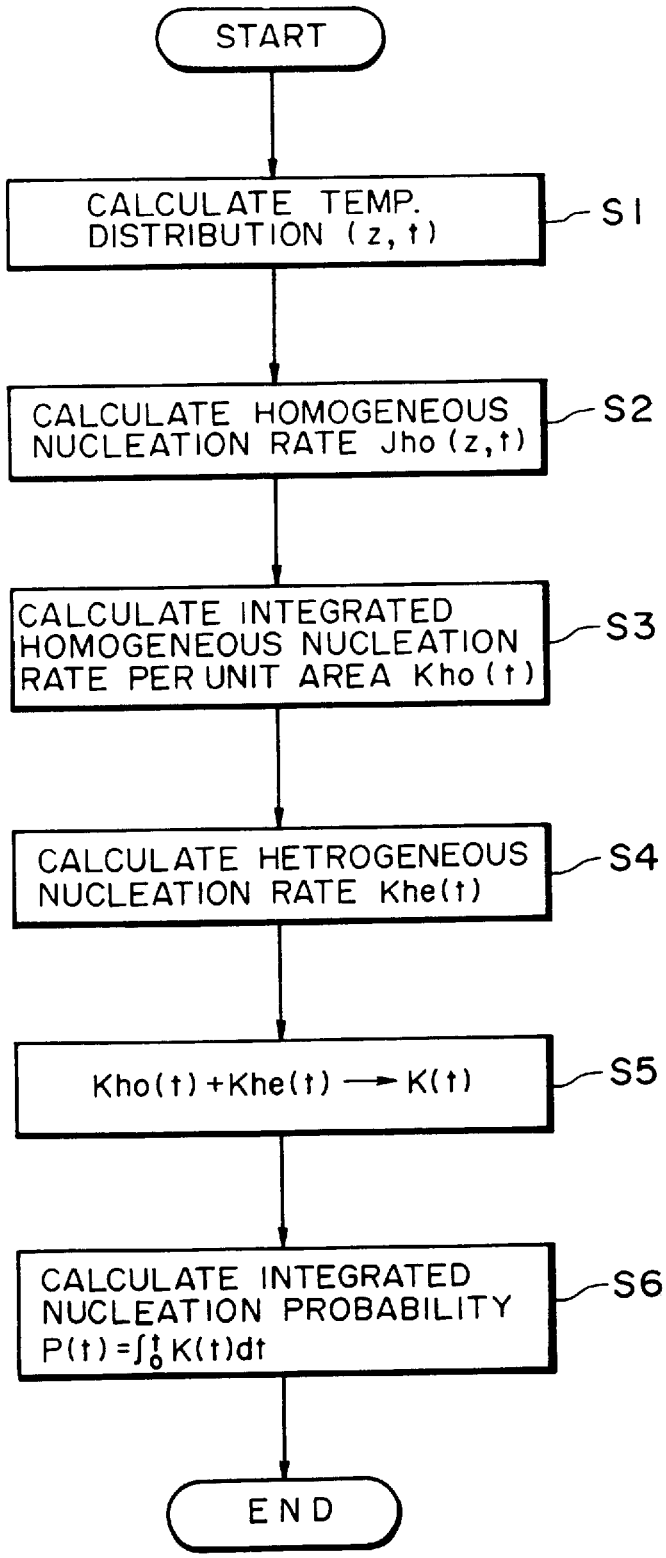
FIG. 1 is a flowchart illustrating an analyzing method of the bubble formation phenomenon according to an embodiment of the present invention.

Referring to FIG. 1, there is shown a flowchart of an example of an analyzing method of the bubble creation.

The method comprises a temperature distribution calculation step S1, a homogeneous nucleation rate (frequency) calculation step S2, an integration step S3 of the homogeneous nucleation rate in a spatial region, a heterogeneous nucleation rate calculation step S4, a step S5 of adding the homogeneous nucleation rate and the heterogeneous nucleation rate, and a step S6 of calculating an integrated nucleation probability which is an integration in a time region of the sum obtained by the step S5, as a nucleation rate.

These calculations can be carried out, using an ordinary digital calculator, an analog calculator or a combination thereof.

Figure 2:
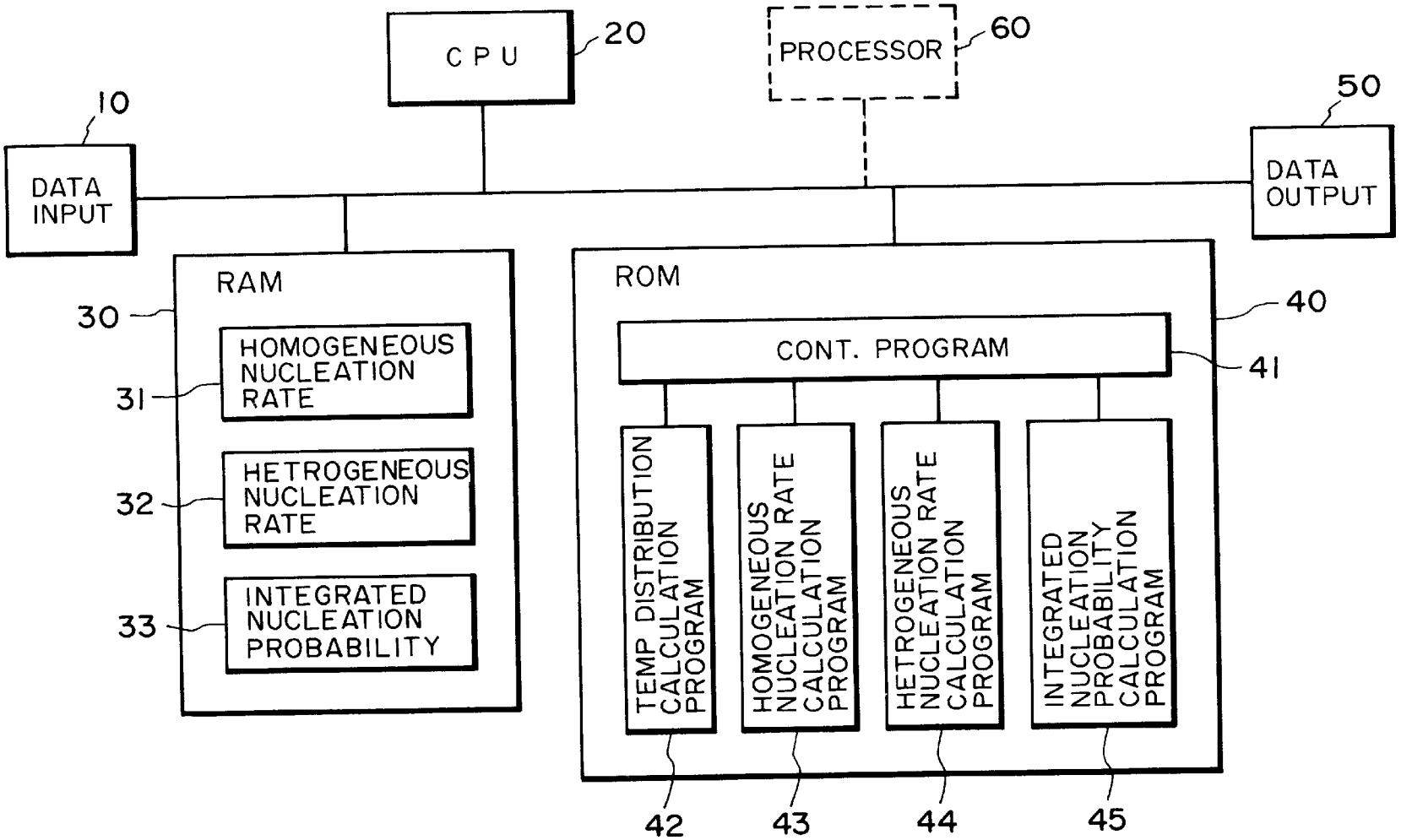
FIG. 2 shows an example of a system for executing the method shown in FIG. 1, using a computer, according to an embodiment of the present invention.

FIG. 2 shows an example of a system for execution of the calculations using a digital computer. The system comprises a data input port 10 for input of the material properties such as a thermal capacity of the ink and various parameters indicative of the structures of the ink jet recording head using the thermal energy, and a CPU 20 for calculating and controlling the integrated nucleation probability in accordance with the program stored in ROM 40 and using RAM 30. The RAM 30 is provided with homogeneous nucleation rate memory 31, heterogeneous nucleation rate memory 32, integrated nucleation probability memory 33 and the like. The ROM 40 includes a control program 41 for controlling the calculation process, a temperature distribution calculation program 42, a homogeneous nucleation rate calculation program 43, a heterogeneous nucleation rate calculation program 44, an integrated nucleation probability calculation program 45, and an unshown integration calculation program, a sum calculation program and the like. The system further comprises a data output port 50 through which the results of the calculations are displayed or printed as they are, or with re-arrangement. In order to increase the calculation speeds, additional calculation processor 60 indicated by broken lines may be used.

The calculations at each of the steps of FIG. 1 will be described in detail.

Step S1

The calculation may be executed by solving an equation of heat conduction using a numerical analysis such as a finite element method or a boundary element method or using an analytic method such as the Laplace transformation method, the Fourier transformation method, the infinite series development method or the Green function method. The easiest way will be to obtain a temperature distribution T(2) when a constant heat flux q is supplied from an end surface z=0 to a semi-indefinite region z≧0 from time 0 to $t_1$, by the following:

$$T(z) = T_{amb} + 2q\sqrt{\frac{t}{k_l c_l \rho_l}}\left[\frac{1}{\sqrt{\pi}}\exp(-\zeta^2) - \zeta\,\mathrm{erfc}(\zeta)\right], \quad \text{for } t \le t_1, \tag{1}$$

$$T(z) = T_{amb} + 2q\sqrt{\frac{t}{k_l c_l \rho_l}}\left[\frac{1}{\sqrt{\pi}}\exp(-\zeta^2) - \zeta\,\mathrm{erfc}(\zeta)\right] - 2q\sqrt{\frac{t-t_1}{k_l c_l \rho_l}}\left[\frac{1}{\sqrt{\pi}}\exp(-\zeta_1^2) - \zeta_1\,\mathrm{erfc}(\zeta_1)\right], \quad \text{for } t > t_1,$$

$$\zeta = \frac{z}{2\sqrt{a_l t}},$$

$$\zeta_1 = \frac{z}{2\sqrt{a_l (t-t_1)}},$$

where Tamb is the ambient temperature, k is the thermal conductivity of the ink, c is the specific heat of the ink, ρ is the density of the ink, and a=k/(c×ρ).

Step S2

Equation of homogeneous nucleation rate on the basis of the nucleation theory is used. The easiest way is to use the classical nucleation theory. According to this theory, the homogeneous nucleation rate Jho per unit time and volume due to the thermal fluctuation of ink liquid is estimated (M. Blander and J. L. Katz:Bubble nucleation in liquids, AIChE J. 21 (1975) 833–848), as follows:

$$J_{ho} = \frac{N_A \rho_l}{m_l}\left(\frac{3N_A\sigma}{\pi m_1}\right)^{\frac{1}{2}}\exp\left[-\frac{\Delta G_{ho}}{k_B T}\right], \quad \Delta G_{ho} = \frac{16\pi\sigma^3}{3(p_v - p_l)^2}, \tag{2}$$

where $N_A$ is the Avogadro number, $k_B$ is the Boltzmann constant, m is the molecular weight of the liquid P is the density of the ink, σ is the surface tension of the ink, $p_v$ is the pressure in the critical size bubble, and $P_{amb}$ is the ambient pressure.

The pressure in the critical size bubble is obtained by (C. A. Ward, A. Balakrishnan and F. C. Hopper: Trans. ASME, J. Basic Engng. 85 (1970) 695)

$$p_v = p_s\exp\left[\frac{p_{amb} - p_s}{\rho_l R_v T} - x_a\right] + p_{amb}\frac{x_a}{x_{sa}}, \tag{2'}$$

where $p_s$ is the saturated vapor pressure, Rv ($N_A K_B/m_2$) is the gas constant of the vapor, $x_a$ is the mole ratio of the dissolved air, $x_{sa}$ is the mole ratio of the dissolved air in saturation.

Step S3

The homogeneous nucleation rate Jho is integrated in a spatial region. The easiest way is to integrate it in the direction perpendicular to the heating surface, as follows:

$$K_{ho} = \int_0^{\infty} J_{ho}(z)\,dz. \tag{3}$$

Step S4

The equation of the heterogeneous nucleation rate on the basis of the nucleation theory is used. The easiest way is to use the classical nucleation theory. According to this theory, the heterogeneous nucleation rate Jhe per unit time and area at the interface between the solid and the liquid due to the thermal fluctuation of ink liquid is estimated (S. van Stralen and R. Cole: Boiling phenomena Volume 1, Hemisphere, Washington (1979) p. 84), as follows:

$$K_{he} = \left(\frac{N_A \rho_l}{m_l}\right)^{\frac{2}{3}} \psi \left(\frac{3N_A \sigma}{\pi m_l \phi}\right)^{\frac{1}{2}} \exp\left[-\frac{\Delta G_{he}}{k_B T}\right], \tag{4}$$

$$\Delta G_{he} = \frac{16\pi\sigma^3\phi}{3(p_v - p_{amb})^2},$$

$$\phi = \frac{2 + 3\cos\theta - \cos^3\theta}{4},$$

$$\psi = \frac{1 + \cos\theta}{2},$$

where θ is the contact angle.

Step S5

The results of calculations at steps S3 and S4 are added, as follows:

$$K = K_{ho} + K_{he}. \tag{5}$$

Step S6

The differential equation of the probability P(t) that the nucleation occurs before the time t in the area $S_H$ $$\frac{dP}{dt} = S_H K(1 - P), \tag{6}$$

$$P = 0, \quad \text{for } t = 0.$$

is integrated with time, as follows:

$$P(t) = 1 - \exp\left[-S_H \int_0^t K\,dt\right]. \tag{7}$$

An Example of Obtaining the Integrated Nucleation Probability

Figure 3:
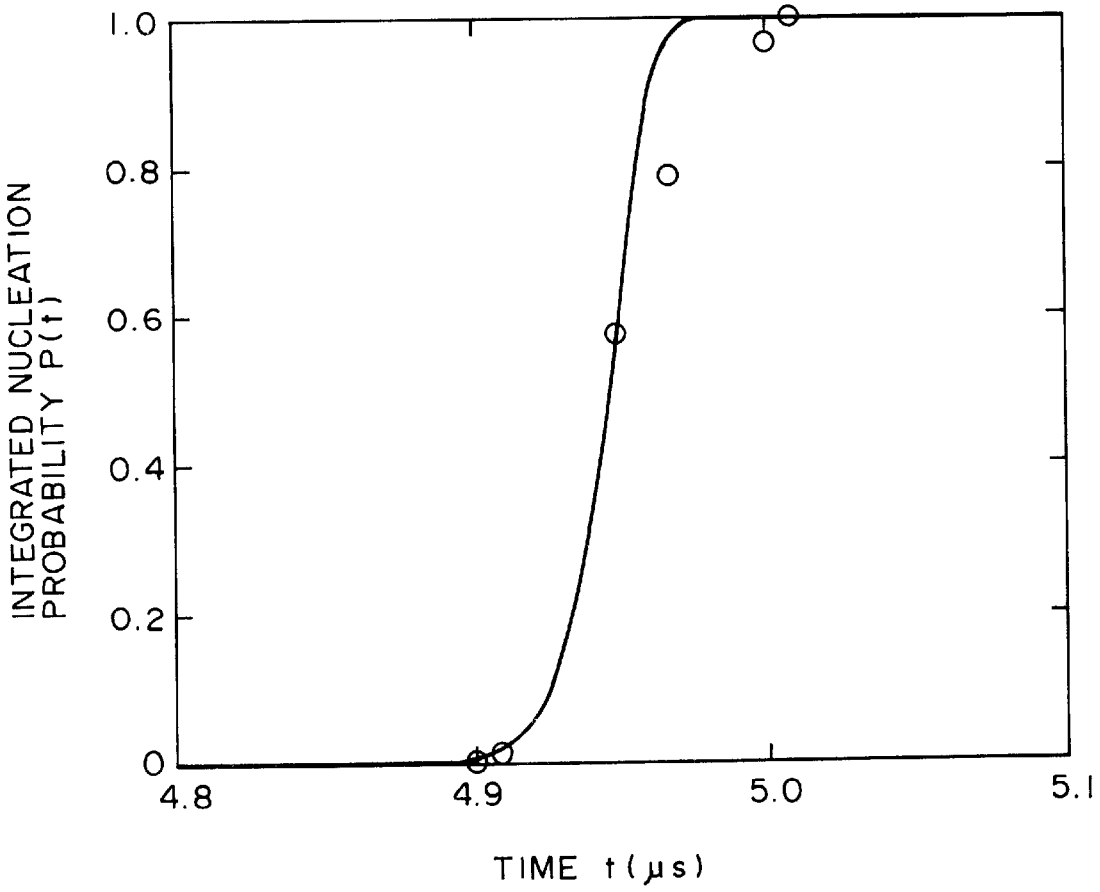
FIG. 3 is a graph showing a result of calculation using the method and system according the embodiments of FIGS. 2 and 3.

FIG. 3 shows by the solid line the relation between the time t and the nucleation probability P(t) calculated through the equations (1)–(7) under the conditions of the surface area of the heater of 30 microns×150 microns and the heat flux of $2\times10^8$ W/m$^2$. It is understood from this FIG. that the incipient boiling time is not a point value but a stochastic variable. Thus, the distribution of the incipient boiling times can be known quantitatively.

Figure 4:
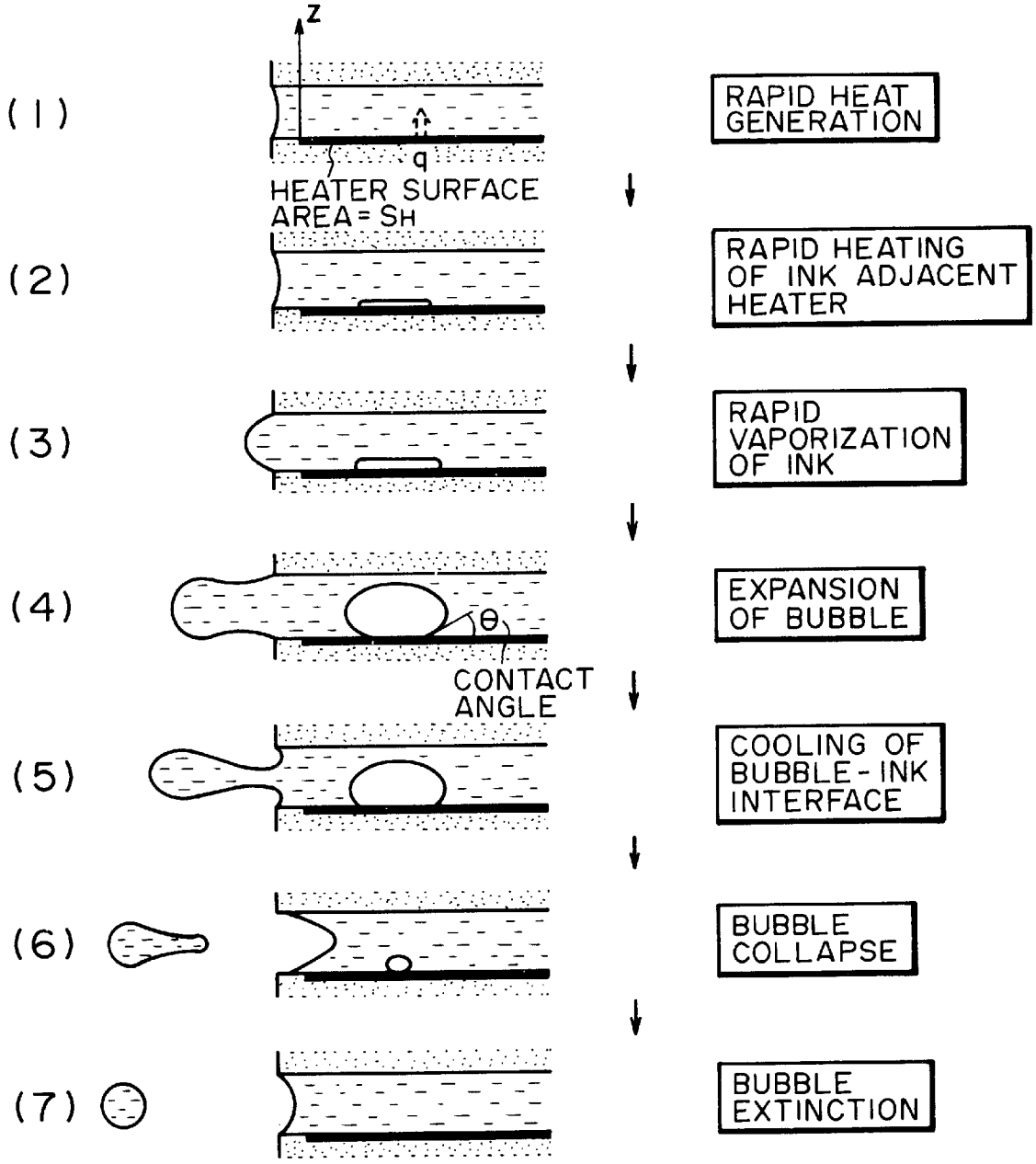
FIGS. 4(1)–(7) are somewhat schematic sectional views illustrating an operational principle of liquid ejection in a bubble jet printer.

FIG. 4 illustrates the operational principle of the ink jet ejection in a bubble jet printer as an exemplary ink jet printer using the thermal energy. In this FIG., The heat flux q and the contact angle θ used in the calculation described in the foregoing are shown.

The ink is supplied into a fine liquid passage. the ink is exposed to the ambient air at the orifice constituting an ink discharge outlet of the passage, and therefore, a meniscus is formed at the orifice ((1) of FIG. 4).

Upon electric energy supply to the heater (electro-thermal transducer) having the surface area $S_H$ the heater generates heat to heat the ink.

By the heating, a part of the ink is evaporated into a bubble ((2) of FIG. 4). The bubble expands by the rapid evaporation of the ink ((3) and (4) of FIG. 4). Then, the ink in the passage is discharged through the orifice by the expansion of the bubble. The bubble reaches its maximum volume state, and thereafter, the ink is cooled by the enclosing ink through the interface between the ink and the vapor, by which the bubble is collapsed. By the cooling, the ink ejected through the orifice is torn from the remainder in the passage, and the ejected ink travels in the form of a droplet ((5) and (6) of FIG. 4). The bubble is extinguished, by which the initial state is restored ((7) of FIG. 4).

In (1) of FIG. 4, the ink in the passage is exposed to the ambience. The heater on the wall (bottom wall) of the passage is supplied with electric current, so that the ink at the heater is evaporated to produce a bubble, which rapidly grows as shown in (2)–(4). The resultant force is effective to discharge the ink (5)–(7).

Comparison Between the Calculation and the Experiment Data

Figure 5:
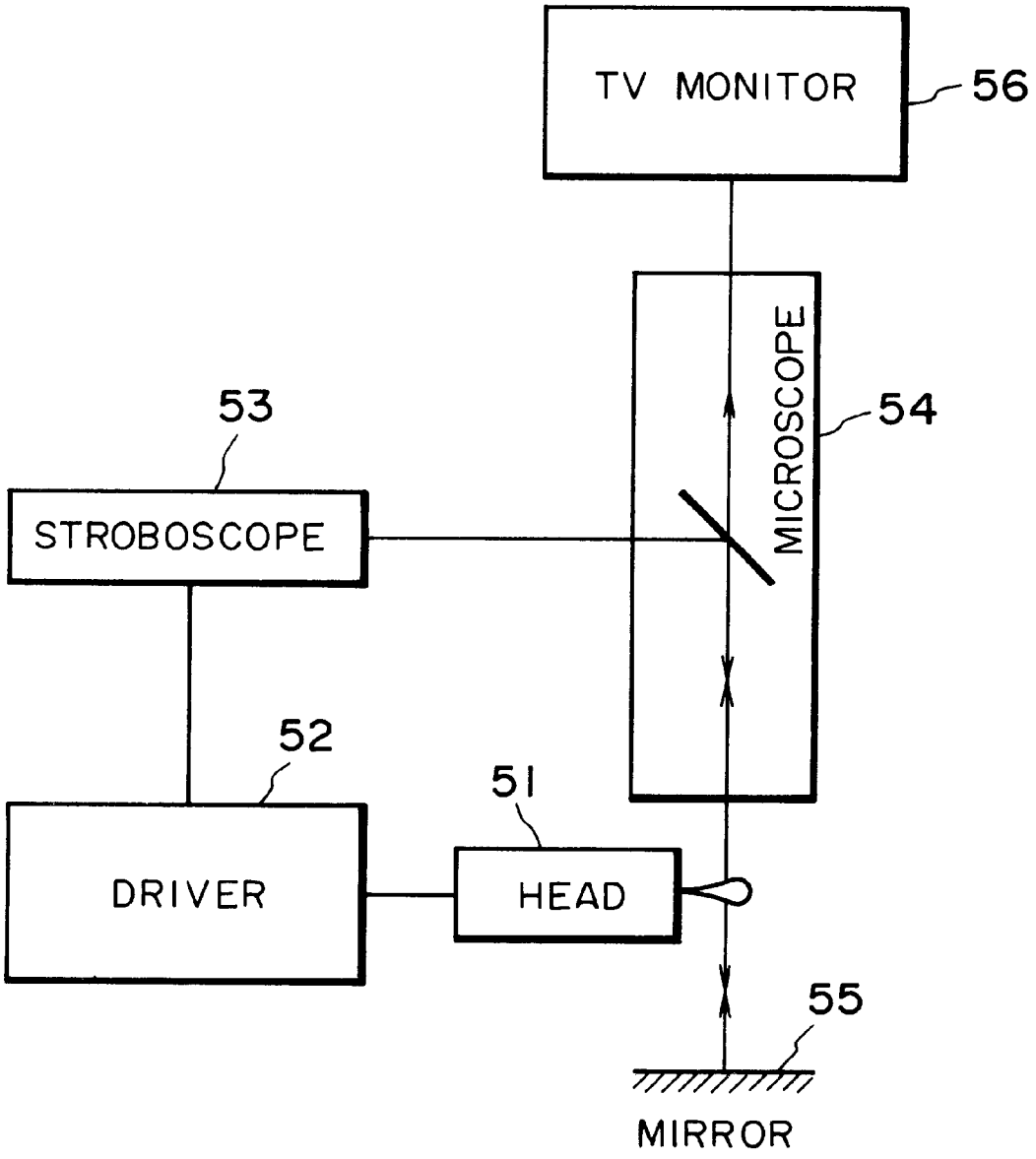
FIG. 5 is a block diagram of a system used in the experiments.

The comparison is made between the results of the calculation described in the foregoing with the data obtained by experiments carried out using a system shown in FIG. 5.

In the system of FIG. 5, a recording head 51 had a heater having the same surface area of 30 microns×150 microns and having the resistance of 68 ohm., the heater being made of $H_fB_2$, for the purpose of comparison with the calculation results. The heater was driven by a driver 52 with the voltage of 24.4 V providing the heat flux of approx. $2\times10^8$ W/m$^2$. The voltage applied from the driver was in the form of a pulse voltage having a frequency of 0.5 Hz. The pulse width was changed.

The droplets ejected through the orifice of the head 51 with different pulse widths were monitored by a TV monitor 56 through a microscope 54 and a mirror 55 with illumination by a stroboscope 53 providing synchronized illumination of 0.5 Hz. The number of the ejection drives for which the ejections of the ink were monitored was 100 for each of the pulse widths. The nucleation probability was obtained as the number of the actual ink ejections in the 100 ejection drives.

In FIG. 3, the results of the experiments are plotted. It is proved that the present method and system are usable, without essential modification, to analysis of the bubble production in an ink jet printer using a thermal energy such as a bubble jet printer. It has also been confirmed that the results of calculations according to this method agreed with the experiment data obtained heretofore as to the effect, to the bubble generation phenomenon, of the change of the heat flux, the effect of the dissolved air in the ink, effect of the wettability of the heating surface or the like.

In the method described in the foregoing, the calculations for the homogeneous nucleation and for the heterogeneous nucleation are executed separately from each other, but they may be made simultaneously. For simplification, only one may be taken. However, it is preferable to obtain the nucleation probability on the basis of the separated calculations for the homogeneous and heterogeneous nucleations, and then, they are added, the separation having not been recognized heretofore.

Thus, the nucleation rate dependent on the ink temperature is integrated in the time and space regions, so that the change of the integrated nucleation probability can be known, by which the stochastic properties of the nucleation in the ink jet printer can be quantitatively obtained.

As described in the foregoing, according to the present invention, the quantitatively analysis of the stochastic aspect of the nucleation phenomenon in the ink jet printer can be accomplished. This is used for the designing and evaluation of the ink jet printer using the thermal energy such as the bubble jet printer.

What is claimed is:

1. Apparatus for determining integrated nucleation probability for an ink jet system that uses thermal energy generated by a heat generating element that is responsive to a heating drive signal so as to generate bubbles in ink, said apparatus comprising:

a memory to store programmed calculation steps including steps by which integrated nucleation probability is determinable;

a central processing unit for executing said programmed calculation steps stored in said memory so as to determine integrated nucleation probability;

wherein said programmed calculation steps include (a) a temperature calculation step to calculate a temperature distribution of ink on the heat generating element, (b) a rate calculation step to calculate rate of nucleation of bubbles based on the temperature distribution of ink calculated in said temperature calculation step, and (c) an integrating step to integrate the rate of nucleation from said rate calculation step with respect to time, so as to obtain integrated nucleation probability as a function of time of the heating drive signal.

2. A system according to claim 1, wherein said memory is comprised by a random access memory.

3. A system according to claim 1, wherein said programmed calculation steps further include a control program by which said central processing unit controls itself.

4. A system according to claim 1, wherein said rate calculation step includes steps to calculate a nucleation rate per unit area and further includes at least one of a a homogeneous nucleation rate and a a heterogeneous nucleation rate.

5. A system according to claim 1, wherein said memory is comprised at least in part by a read only memory.

6. A system according to claim 1, further comprising a data output port connected with a printer, and wherein said central processing unit is adapted to output the integrated nucleation probability from said integrating step to said data output port.

7. A system according to claim 1, further comprising a data output port connected with display means, and wherein said central processing unit is adapted to output the integrated nucleation probability from said integrating step to said data output port.

8. A system according to claim 1, wherein said rate calculating step includes steps to calculate both a homogeneous nucleation rate and a heterogeneous nucleation rate, and wherein rate of nucleation is comprised by at least a sum thereof.

9. A system according to claim 8, wherein the homogeneous nucleation rate $K_{ho}$ is calculated by integrating $J_{ho}$ with respect to distance, where $J_{ho}$ is given by:

$$J_{ho} = \frac{N_A \rho_l}{m_l}\left(\frac{3N_A\sigma}{\pi m_1}\right)^{\frac{1}{2}} \exp\left[-\frac{\Delta G_{ho}}{k_B T}\right],$$

$$\Delta G_{ho} = \frac{16\pi\sigma^3}{3(p_v - p_l)^2},$$

$$p_v = p_s \exp\left[\frac{p_{amb} - p_s}{\rho_l R_v T} - X_a\right] + p_{amb}\frac{x_a}{x_{sa}},$$

where $N_A$ is the Avogadro number, $k_B$ is the Boltzmann constant, m is the molecular weight of the liquid, ρ is the density of the ink, σ is the surface tension of the ink, $P_v$ is the pressure in the critical size bubble, $P_{amb}$, $P_s$ is the saturated vapor pressure, $R_v$ (=$N_A K_B/m_2$is) is the gas constant of the vapor, $x_a$ is the mole ratio of the dissolved air, $x_{sa}$ is the mole ratio of the dissolved air in saturation, and T is the temperature distribution in said temperature calculating step.

10. A system according to claim 8 or 9, wherein the heterogeneous nucleation rate $K_{he}$ is calculated by $$K_{he} = \left(\frac{N_A \rho_l}{m_l}\right)^{\frac{2}{3}}\left(\psi\left(\frac{3N_A\sigma}{\pi m_l \phi}\right)\right)^{\frac{1}{2}} \exp\left[-\frac{\Delta G_{he}}{k_B T}\right],$$

$$\Delta G_{he} = \frac{16\pi\sigma^3\phi}{3(p_v - p_{amb})^2},$$

$$\phi = \frac{2 + 3\cos\theta - \cos^3\theta}{4},$$

$$\psi = \frac{1 + \cos\theta}{2},$$

where $N_A$ is the Avogadro number, $k_B$ is the Boltzmann constant, m is the molecular weight of the liquid, ρ is the density of the ink, σ is the surface tension of the ink, $p_v$ is the pressure in the critical size bubble, $p_{amb}$ is ambient pressure, θ is a contact angle, and T is the temperature distribution in said temperature calculating step.

11. Computer-executable process steps stored on a computer-readable memory medium, the steps to determine integrated nucleation probability in an ink jet system that uses thermal energy generated by a heat generating element that is responsive to a heating drive signal so as to generate bubbles in ink, the steps comprising:

a temperature calculation step to calculate a temperature distribution of ink on the heat generating element;

a rate calculation step to calculate rate of nucleation of bubbles based on the temperature distribution of ink calculated in said temperature calculation step; and an integrating step to integrate the rate of nucleation from said rate calculation step with respect to time, so as to obtain integrated nucleation probability as a function of time of the heating drive signal.

12. Computer-executable process steps according to claim 11, wherein said rate calculation step includes steps to calculate a nucleation rate per unit area and further includes at least one of a step to calculate a homogeneous nucleation rate and a step to calculate a heterogeneous nucleation rate.

13. Computer-executable process steps according to claim 11, wherein said rate calculating step includes steps to calculate both a homogeneous nucleation rate and a heterogeneous nucleation rate, and wherein rate of nucleation is comprised by at least a sum thereof.

14. Computer-executable process steps according to claim 13, wherein the homogeneous nucleation rate $K_{ho}$ is calculated by integrating $J_{ho}$ with respect to distance, where $J_{ho}$ is given by:

$$J_{ho} = \frac{N_A \rho_l}{m_l}\left(\frac{3N_A\sigma}{\pi m_1}\right)^{\frac{1}{2}} \exp\left[-\frac{\Delta G_{ho}}{k_B T}\right],$$

$$\Delta G_{ho} = \frac{16\pi\sigma^3}{3(p_v - p_l)^2},$$

$$p_v = p_s \exp\left[\frac{p_{amb} - p_s}{\rho_l R_v T} - X_a\right] + p_{amb}\frac{x_a}{x_{sa}},$$

where $N_A$ is the Avogadro number, $k_B$ is the Boltzmann constant, m is the molecular weight of the liquid, ρ is the density of the ink, σ is the surface tension of the ink, $p_v$ is the pressure in the critical size bubble, $P_{amb}$, $p_s$ is the saturated vapor pressure, $R_v$ (=$N_A K_B/m_2$is) is the gas constant of the vapor, $x_a$ is the mole ratio of the dissolved air, $x_{sa}$ is the mole ratio of the dissolved air in saturation, and T is the temperature distribution in said temperature calculating step.

15. Computer-executable process steps according to claim 13 or 14, wherein the heterogeneous nucleation rate $K_{he}$ is calculated by $$K_{he} = \left(\frac{N_A \rho_l}{m_l}\right)^{\frac{2}{3}}\left(\psi\left(\frac{3N_A\sigma}{\pi m_l \phi}\right)\right)^{\frac{1}{2}} \exp\left[-\frac{\Delta G_{he}}{k_B T}\right],$$

$$\Delta G_{he} = \frac{16\pi\sigma^3\phi}{3(p_v - p_{amb})^2},$$

$$\phi = \frac{2 + 3\cos\theta - \cos^3\theta}{4},$$

$$\psi = \frac{1 + \cos\theta}{2},$$

where $N_A$ is the Avogadro number, $k_B$ is the Boltzmann constant, m is the molecular weight of the liquid, ρ is the density of the ink, σ is the surface tension of the ink, $P_v$ is the pressure in the critical size bubble, $p_{amb}$ is ambient pressure, θ is a contact angle, and T is the temperature distribution in said temperature calculating step.

* * * * *

UNITED STATES PATENT AND TRADEMARK OFFICE

CERTIFICATE OF CORRECTION

PATENT NO. : 6,189,994 B1
DATED : February 20, 2001
INVENTOR(S) : Akira Asai

It is certified that error appears in the above-identified patent and that said Letters Patent is hereby corrected as shown below:

Drawings,
Sheet 1, Figure 1,
"HETROGENEOUS" should read -- HETEROGENEOUS --.

Sheet 2, Figure 2,
"HETROGENEOUS" (both occurences) should read -- HETEROGENEOUS --.

Column 1,
Line 31, "makes" should read -- causes --.

Column 2,
Line 41, "Accoording" should read -- According --.

Column 4,
Line 8, "T(2)" should be deleted;
Line 51, "liquid P" should read -- liquid. $\rho$ --; and
Line 64, "$(N_A K_B/m_2)$" should read -- $(=N_A K_B/m_2)$ --.

Column 5,
Line 13, "Jhe" should read -- $K_{he}$ --.

Column 7,
Line 45, "a a" should read -- a --; and
Line 46, "a a" should read -- a --.

Column 8,
Line 23, "$(\psi(3NA\sigma))^{1/2}$" should read -- $\psi(3NA\sigma)^{1/2}$ --
$\pi m1\phi$ $\pi m1\phi$

UNITED STATES PATENT AND TRADEMARK OFFICE

CERTIFICATE OF CORRECTION

PATENT NO. : 6,189,994 B1
DATED : February 20, 2001
INVENTOR(S) : Akira Asai

It is certified that error appears in the above-identified patent and that said Letters Patent is hereby corrected as shown below:

Column 9,
Line 23, "by." should read -- by: --.

Signed and Sealed this

Twenty-ninth Day of January, 2002

*Attest:*

*Attesting Officer*

JAMES E. ROGAN
*Director of the United States Patent and Trademark Office*